US008540924B2

(12) United States Patent
Hoffman et al.

(10) Patent No.: US 8,540,924 B2
(45) Date of Patent: Sep. 24, 2013

(54) METHOD AND DEVICE FOR PREHEATING A PRESSED MATERIAL MAT DURING MANUFACTURE OF WOOD MATERIAL BOARDS

(75) Inventors: Werner Hoffman, Eppingen (DE); Ulf Konekamp, Karlsruhe (DE); Gernot von Haas, Heidelberg (DE)

(73) Assignee: Dieffenbacher GmbH Maschinen-und Anlagenbau, Eppingen (DE)

( * ) Notice: Subject to any disclaimer, the term of this patent is extended or adjusted under 35 U.S.C. 154(b) by 209 days.

(21) Appl. No.: 12/811,109

(22) PCT Filed: Dec. 27, 2008

(86) PCT No.: PCT/EP2008/011122

§ 371 (c)(1),
(2), (4) Date: Dec. 3, 2010

(87) PCT Pub. No.: WO2009/083247

PCT Pub. Date: Jul. 9, 2009

(65) Prior Publication Data

US 2011/0089611 A1 Apr. 21, 2011

(30) Foreign Application Priority Data

Dec. 30, 2007 (DE) ..... 10 2007 063 374

(51) Int. Cl.
*B27N 3/18* (2006.01)

(52) U.S. Cl.
USPC ..... 264/489; 264/40.1; 264/460; 425/174.4; 425/136; 219/700; 219/701; 219/702; 219/494; 219/388; 219/395; 219/483; 219/487; 219/710; 219/717

(58) Field of Classification Search
USPC ..... 264/40.1, 460, 489; 425/174.4, 425/136; 34/264; 219/700–702, 494, 388, 219/395, 483, 487, 710, 717
See application file for complete search history.

(56) References Cited

U.S. PATENT DOCUMENTS 2,570,280 A * 10/1951 Roffman ..... 169/61
4,018,642 A * 4/1977 Pike et al. ..... 156/272.2

(Continued)

FOREIGN PATENT DOCUMENTS

CA 2443799 A1 4/2004
DE 21 13 763 A1 9/1972

(Continued)

OTHER PUBLICATIONS

International Search Report dated Apr. 17, 2009, as received in corresponding PCT Application No. PCT/EP2008/011122, 6 pages.

(Continued)

*Primary Examiner* — Christina Johnson
*Assistant Examiner* — Saeed Huda
(74) *Attorney, Agent, or Firm* — Foley & Lardner LLP

(57) ABSTRACT

The invention relates to a method for preheating a pressed material mat (14) spread on an endlessly and continuously circulating molding band (6) during manufacture of wood material boards, wherein microwaves from one or both press surface sides are beamed into the pressed material mat (14) to preheat the pressed material mat (14) and the pressed material mat (14) is compacted and hardened by application of pressure and heat after transfer to a continuously operating press (1). The invention consists of microwaves in a frequency range of 2400-2500 MHz being used to heat the pressed material mat (14), wherein the microwaves for each press surface side are generated from 20 to 300 microwave generators (26) with magnetrons (20) of a respective output of 3 to 50 kW. A device for preheating pressed material mats (14) is also provided, in which 20 to 300 microwave generators (26) with magnetrons (20) with an output of 3 to 50 kW and with a frequency range of 2400-2500 MHz are arranged in a conveyor furnace (4) per area side.

14 Claims, 3 Drawing Sheets

(56) References Cited

U.S. PATENT DOCUMENTS

| | | | | |
|---|---|---|---|---|
| 4,038,531 | A * | 7/1977 | Loe, Jr. | 700/112 |
| 4,298,418 | A * | 11/1981 | Takagi | 264/489 |
| 4,557,882 | A * | 12/1985 | Arnold | 264/40.4 |
| 4,771,156 | A * | 9/1988 | Strattan et al. | 219/757 |
| 5,641,449 | A * | 6/1997 | Owens | 264/404 |
| 5,756,975 | A * | 5/1998 | Harris et al. | 219/696 |
| 5,892,208 | A * | 4/1999 | Harris et al. | 219/696 |
| 5,895,546 | A * | 4/1999 | Bielfeldt et al. | 156/304.1 |
| 6,242,726 | B1 * | 6/2001 | Harris et al. | 219/764 |
| 7,048,825 | B2 * | 5/2006 | Churchland et al. | 156/379.6 |
| 7,067,035 | B2 * | 6/2006 | Churchland et al. | 156/379.6 |
| 2004/0065982 | A1 * | 4/2004 | Churchland et al. | 264/463 |
| 2005/0155703 | A1 * | 7/2005 | Churchland et al. | 156/275.5 |
| 2005/0238865 | A1 * | 10/2005 | Konishi | 428/292.1 |
| 2006/0049537 | A1 * | 3/2006 | Christoffersen | 264/40.1 |
| 2008/0088049 | A1 * | 4/2008 | Dostal | 264/40.7 |
| 2008/0104857 | A1 * | 5/2008 | Hecht et al. | 34/259 |
| 2010/0090359 | A1 * | 4/2010 | Schuermann et al. | 264/40.1 |

FOREIGN PATENT DOCUMENTS

| | | | |
|---|---|---|---|
| DE | 44 12 515 | A1 | 10/1995 |
| DE | 196 27 024 | A1 | 1/1998 |
| DE | 197 18 772 | A1 | 11/1998 |
| DE | 694 19 631 | T2 | 1/2000 |
| DE | 101 57 601 | A1 | 6/2003 |
| EP | 0 268 379 | A | 5/1988 |
| EP | 1 225 027 | A | 7/2002 |
| RU | 2040498 | C1 | 7/1995 |
| WO | WO-2006/056175 | A | 6/2006 |
| WO | WO 2007/065668 | A1 | 6/2007 |

OTHER PUBLICATIONS

Russian Office Action received in connection with Russian application No. 2010132157 (English Translation attached); dtd Nov. 2012.

* cited by examiner

METHOD AND DEVICE FOR PREHEATING A PRESSED MATERIAL MAT DURING MANUFACTURE OF WOOD MATERIAL BOARDS

The invention concerns a method for preheating of a pressed material mat spread on an endless, continuously running shaping belt during production of wooden boards and a device for preheating of a pressed material mat spread on an endless, continuously running shaping belt during production of wooden boards.

The use of high frequencies as a means to preheat chip or fiber products in order to reduce the compression factor during the subsequently initiated compression process is known from the patent literature and the industry to increase production output. Use of microwaves as heat energy for plywood, particle board, chipboard and corrugated boards is known from U.S. Pat. No. 4,018,642 A, in which migrating waves are applied to the pressed material in a targeted fashion via so-called wave rectifiers with a frequency in the range from 100 to 10,000 MHz. This U.S. Pat. No. 4,018,642 essentially treats preheating and curing of alkaline resins and similar glue compositions. The efficiency is generally less than 50%. It is therefore not economically useful to use this type of heating for curing of a pressed material mat, but only for preheating of shaken and optionally pre-compacted pressed material mats. The essential problems and hazards of high-frequency heating are non-uniform heating of the pressed material mat, control difficulties of the high-frequency energy being supplied and breakthroughs that occur. To manage these difficulties, targeted compaction measures between microwave stations are described in DE 21 13 763 B2.

Devices for production of wooden boards or veneer panels with microwave preheating are also known from DE 197 18 772 A1 or DE 196 27 024 A1. Preheating of the pressed material (pressed material mat, pressed material strand) by means of microwaves has already been successfully conducted for a long time with these devices. This technology has worked, in particular, in methods for production of very thick wooden boards or veneer panels with thicknesses of up to 150 mm, which could not be economically produced without a preheating device. Mostly continuous tunnel furnaces are used as microwave preheating devices. Since the board width is many times larger than the board thickness during production of wooden boards, the microwaves are emitted at right angles to the wooden board plane. The board widths are ordinarily between 1200 and 3900 mm and the board thicknesses 30 to 150 mm. Generation of microwaves occurs in microwave generators, in which the high frequency modulation and magnetron tubes are accommodated. Owing to the high microwave power demand, several generators are required for one preheating device, which generally have an output power of 75-100 kW per generator and are accommodated in sealed electrical switch cabinets next to the production installation. From there, the generated microwaves are guided by hollow waveguides to the actual heating cell in the production unit, during which one hollow waveguide is necessary for each generator. In order to achieve the most uniform possible heat distribution in the pressed material passing through, the microwaves guided into the hollow waveguides are branched, coming from the individual generators, and the number of energy-guiding hollow waveguides is therefore multiplied, so that a close grid of feed sites beneath and above the heating cell can be achieved. Today, 1 in 2 branching is common, which means the energy coming from four generators, which is initially guided in four waveguides, is subdivided in up to 8 waveguides, which discharge at 8 feed sites.

Feeding into the heating cell occurs by means of round hollow waveguides, which are mounted vertically upright beneath and above the heating cell. A measurement and control device is required for each feed site, with which the phase position of the microwave is tuned. The investment costs for such a microwave preheating device are very high and therefore have only successfully gained acceptance thus far in installations for production of veneer panels.

A device for heating of pressed material with microwave energy was created with DE 101 57 601 A1, with which the investment costs are reduced, the installation availability increased and the control costs lowered. This task was solved in that the microwave preheating device consists of a heating cell designed as a continuous furnace, in which supply of microwaves into the pressed material occurs via rod antennas with reflection screens arranged one behind the other, which are mounted horizontally and across the production direction above and/or beneath the pressed material within the heating cell, reflection surfaces being assigned to the rod antennas on the opposite surfaces of the pressed material. Supply of microwaves can then occur also by means of hollow waveguides from the generators to the heating cell, in which, owing to the emission characteristics of the rod antennas, no additional branching of the hollow waveguides coming from the generators is generally necessary, which means the number of feed sites corresponds to the number of generators. Waveguide transitions expressly developed for this purpose are used for the transition from the hollow waveguides to the rod antennas. This type of preheating has worked, in principle, but still suffers from shortcomings with respect to the extensive design space and high power demand of individual components.

The following frequency ranges for high-frequency and microwaves in the described industrial application are found from experience and the patent literature. A frequency of less than 300 MHz is ordinarily understood to be high-frequency and a frequency of 300 MHz to 300,000 MHz is microwave frequency.

A high-frequency wave with 13.56 MHz and a power of 8 kW is used in DE 694 19 631 T2. Mention of a working frequency of 21.12 MHz or 13.56 MHz is found in DE 44 12 515 A1. Microwave heating with a frequency band of 915 MHz is known from CA 2 443 799 C, in which the microwaves are introduced here directly into the entry gap (area of the tapering press gap at the entry to a continuously operating press) into the pressed material mat. In addition to a very demanding design, problems have also been found through unmanageable reflections on the steel belts during operation.

In principle, the prior art lacks specific comments with respect to optimal frequency range in conjunction with the necessary power demand and radiation capacity and in conjunction with the necessary number of generators for heating of a pressed material mat of differentiated properties running at a stipulated speed. One generally reads in the patent literature: The precise layout of the microwave device for this or any method is left to one skilled in the art (on location) and information concerning frequency are restricted to the microwave range or contain data extending over several orders of magnitude. No instructions are apparent to one skilled in the art from these statements on implementation of instructions with respect to these parameters from the patent literature concerning an optimal and useful frequency. It was found that one skilled in the art is essentially left to his own designs and can decide which frequency might be chosen in a range of frequencies during use of microwaves over several orders of magnitude ($3\times10^2$ MHz to $3\times10^6$ MHz).

As already mentioned, another drawback is that greater equipment expense must be incurred to ensure radiation safety for personnel and machines, if the high-frequency or microwave frequencies are generated in separate installations (generally right next to the main current connections) and must be guided for use in the production installation by waveguides. In addition to massive waste of useful design space, costly radiation detectors must be mounted in a safety area against possible damage to the so-called waveguides. All this hampers minimal maintenance (on inspection) and requires high costs during repairs and shutdowns. A plant economic loss of up to 30%, despite continuing production, is incurred merely by the failure of a preheating unit, since the compression factor without preheating is significantly increased and the production speed must be reduced by one-third.

The task of the present invention consists of creating a method and device that makes it possible to provide high efficiency for heating of pressed material mats with an appropriate frequency, in which heating is to be conducted uniformly and as ecologically and economically as possible in terms of energy, before this pressed material mat is compressed in a continuously operating press. At the same time, the method and device make it possible to use components with lower power demand. The device created in this context is usable with the method, but is also functional independently and should have easily replaceable components and high resistance to interference.

The solution for creation of a method consists of the fact that microwaves of a frequency range of 2400-2500 MHz are used to heat the pressed material mat, in which the microwaves are generated for each pressed surface side from 20 to 300 microwave generators with magnetrons with a corresponding power of 3 to 50 kW.

The solution for a device to execute the method or as an independent device consists of the fact that 20 to 300 microwave generators with magnetrons having a power from 3 to 50 kW and a frequency range of 2400-2500 MHz are arranged in a continuous furnace per press surface side.

Pressed material mats with a basis weight from 2 to 40 kg/m$^2$ are preferably heated with this method and an appropriate installation and are moved with an advance speed from 50 to 2000 m/s. The mat height after pre-compression during MDF board production then lies at 40 to 350 mm and during chipboard production, at 30 to 200 mm. Oriented strand board (OSB) can be used without pre-compression in a height from 50 to 500 mm. In a preferred variant, for these basic data of the pressed material mat being heated, magnetrons with a power from 6 to 20 kW are particularly suited. The employed frequency lies in the ISM band (Industrial Science Medicine band) and is an internationally recognized frequency band for microwaves not subject to approval.

It has now been shown in experiments that a large amount of microwaves are absorbed in a pressed material mat up to a penetration depth of 200 mm at a microwave length of 12 cm. These physical circumstances could also be checked by calculation; one speaks of a penetration depth "d," referred to by definition as the distance from the surface, at which the energy of the waves has dropped to 1/e=0.37, in which this corresponds to about 37% of the "field intensity E prevailing in the outer material layers."

$$d = \frac{c}{\pi\sqrt{\varepsilon_r'}\sqrt{2\left(\sqrt{1+\tan^2\delta}-1\right)}}\cdot\frac{1}{f}$$

With the following boundary conditions f=frequency=2.45 GHz, c=speed of light≈$3*10^8$ m/s $\epsilon'_r \approx 3.5$ $\epsilon''_r \approx 0.4$, in which $$\tan\delta = \frac{\varepsilon_r''}{\varepsilon_r'} = 0{,}11428$$

we get the formula $$d = \frac{3\cdot10^8\ \frac{\mathrm{m}}{\mathrm{s}}}{\pi\sqrt{3{,}5}\sqrt{2\left(\sqrt{1+0{,}11428^2}-1\right)}}\cdot\frac{1}{2{,}45\cdot10^9\frac{1}{s}}$$

The penetration depth calculated in this way lies at d=0.183 m.

The previously common high-frequency devices have the drawback that a large amount of radiation emerges from the pressed material mat again or simply passes through it without heating the pressed material mat. Reflectors must therefore be arranged after the pressed material mat on the other side. Extensive calculations for the best possible radiation and corresponding control and regulation costs go hand in hand. In microwave radiation, it has surprisingly been shown, by calculation and corresponding experiments, that a penetration depth of about 200 mm at a frequency of 2450 MHz is present in a pre-compacted pressed material mat made of MDF or similar material. In OSB production, pre-compaction is not provided. Consequently, in a 400 mm high pressed material mat with two-sided radiation, already in the first pass, about 60% of the energy is converted to heat power on the first 200 mm and leads to optimized efficiency during heating. At the same time, smaller pressed material mats half as high can be run with a much higher production speed, since radiation entering from both sides is optimally absorbed and twice the power is available.

The large numbers of generators that are necessary for the device and the method advantageously result in limited size of the radiation openings at the employed microwave frequency. This lies at roughly a 2×5 cm opening. For this reason, it is also possible to arrange a number of generators in the width and in a small design space. The waveguide connectors at the output are preferably covered, in order to protect them from possible dust development. During use of the previously common high-frequency radiation for heating of pressed material mats (930 MHz), much larger waveguides are required, so that a larger number of generators and waveguides would also not be installable over the width of a pressed material mat. A microwave generator is preferably designed in modular fashion and can be easily disassembled on location into individual parts for repair or replacement. It is also possible to provide an entire microwave generator (magnetron, circulator and tuner, etc.) as module and to provide it with quick-change closures for assembly and disassembly. Failed microwave generators can be quickly removed from the device without a problem and replaced with new ones. Replacement of individual parts in the previously used high-frequency units entails a very extensive repair, for which large hoisting and assembly devices must be used, in addition to high personnel costs. The expense for necessary materials alone or personnel in a three-shift operation in the event of a disturbance on location is costly and takes considerable time. On the other hand, replacement of a modular microwave generator is simple, can be performed without a problem by one or two persons and does not take much time. Such modules, because of their size, can be kept on hand Without a problem and an installer is usually always on site during operation of the installation.

A metal detector can be arranged in the installation or in the device, in order to examine the pressed material mat before microwave heating for metal parts. Metal parts larger in their dimensions in length than ¼ of the wavelength (about 40 mm) are particularly critical. Fires in the pressed material mat can occur in this case by spark formation during heating. Since non-magnetic metal parts can also lead to such reactions and they cannot be removed from the pressed material mat via an ordinary magnetic separator, either a discharge for the pressed material mat for disposal must be possible before heating of the pressed material mat or the microwave generator must be switched off during passage of a recognized metal piece and discharge of the unheated pressed material mat can then occur right before the press. It is necessary to check the pressed material mat passing through for spark formation or fires. This occurs with ordinary sensors and measurement devices. At the same time, means to extinguish fires are advantageously present in the device or already integrated in the production room on location.

In a preferred practical example for the device, the following technical basic conditions are obtained:

The total efficiency of a continuous furnace with microwave generation is obtained from three different efficiencies: $\eta_{tot}=\eta_1*\eta_2*\eta_3$, $\eta_1$ corresponds to the efficiency of the transformer, which converts line voltage on location to a DC voltage. $\eta_2$ corresponds to the efficiency of the employed magnetrons of the microwave generators, which convert the high voltage to microwave generation, and $\eta_3$ is the efficiency of conversion of microwave radiation to heat power in the pressed material mat and corresponds to the temperature increase. Leakage radiation, reflected power, absorber power and the like occur here as loss.

Ordinarily, $\eta_1$ and $\eta_2$ are stated by the corresponding manufacturers and in the preferred practical example have the values $\eta_1=0.95$ and $\eta_2=0.70$. $\eta_3$ could be determined in laboratory experiments and is largely dependent on the basic conditions (for example, plastic belts) and the material being heated. The present material is a mixture of strand and fibers and/or chips, which have been pre-compacted for venting and have relatively low moisture content.

A heat power in the product of 36 kW, corresponding to an efficiency $\eta_3=0.60$, was found in experiments under laboratory conditions at a throughput of 1 kg/s and heating of about 20 K. In a subsequent experiment with 0.5 kg/s, heating around 40 K could be achieved with the same heat power, which confirmed the efficiency. Converted to a large installation with a throughput of 18 to/h atro and a mat width after side trimming from 1850 to 2150 mm, the stipulation is obtained that 18 to of raw material must be heated by the device in the stranding machines per hour from an average temperature of 30° C. to 60° C. At a throughput of 5 kg/s and a desired heating T=30 K, a heat power in the product of 270 kW is therefore obtained. Assuming an efficiency $\eta_3=0.60$, a total efficiency of $\eta_{tot}=0.40$ is obtained and a total connection power of 675 kW. The required number of magnetrons and their power is then obtained in a further conversion at 450 kW. Distributed over a selected number of magnetrons, for example, 50 magnetrons with a power of 9 kW is obtained. 25 magnetrons in corresponding microwave generators are thus incorporated in the device per press surface side. The design space, according to experience, is quite sufficient for this purpose, so that there are even possibilities for expansion, in order to, say, double the capacity and/or incorporate microwave generators or magnetrons as spares on location, in order to use one set in alternation. Unforeseen overheating states in the device and usual equipment problems accompanying 24/7 permanent operation can therefore be avoided. It is obvious to one skilled in the art that corresponding control and regulation mechanisms and remote monitoring should be provided for such a device. A control loop is also usefully provided, which accordingly adjusts the throughput in kg/s to the power of the microwave generators and ensures optimal and energy-saving application. Values concerning the moisture content of the pressed material mat, density, speed and the like must flow into this control loop, in order to permit useful control. Corresponding measurement equipment can then be provided in the device.

In another preferred variant, the following structure of the device is present.

The shaping belt has a greater width than the microwave belt used in the continuous furnace. The latter preferably consists of Kevlar® This circumstance arises from the need to permit very broad scatter, which is then reduced by 10-20%, since the edges of a stranded pressed material mat generally have non-homogeneities, like stranding errors or undesired elevations of density. For example, a 2500 mm wide pressed material mat, before entering the pre-press, is trimmed to a width of 2250 mm. It is therefore sufficient if the microwave belt in the continuous furnace has a width of 2300 mm. This is advantageous in the necessary configuration of sealing of the edge radiation from microwave generation in the continuous furnace. Advantageously, stationary absorption devices or elements are provided on the long sides and movable ones at the entry and exit of the continuous furnace, which trap the edge and scattered radiation. Special attention must be devoted to maintaining moisture in the pressed material mat and, in order to avoid moisture loss during heating by evaporation of moisture, it could also be necessary to provide an endless revolving plastic belt lying on the pressed material mat. Heating by means of microwaves advantageously produces a uniform temperature distribution of ±7° C. in the press material mat 14 over its length and width.

Other advantageous measures and embodiments of the object of the invention follow from the dependent claims and the following description with the drawing. In the drawing:

Figure 1:
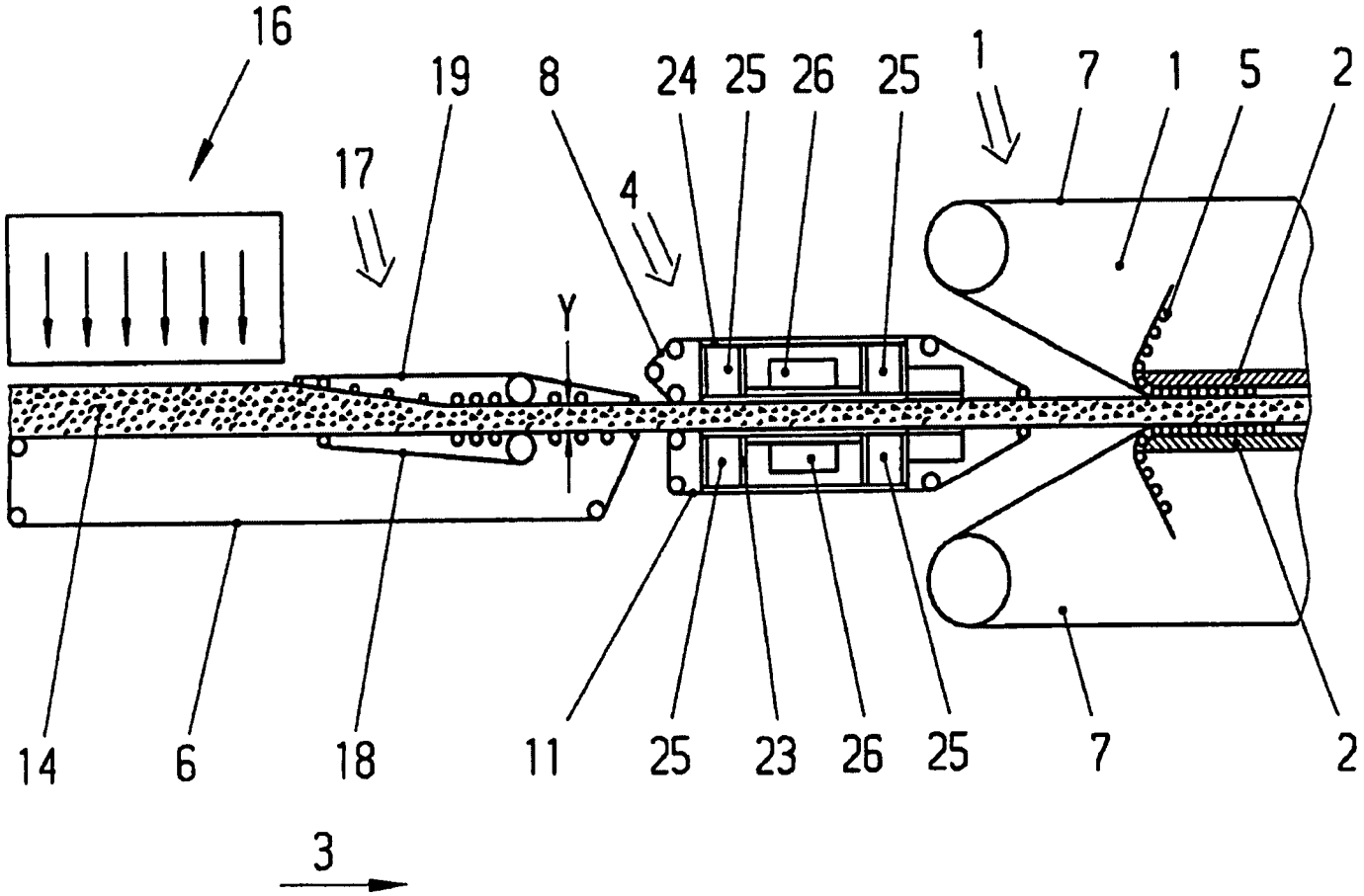
FIG. 1 shows a schematic side view of an installation for production of material boards from stranding of a press material mat on a shaping belt up to the beginning of a continuously operating double-belt press.

A production unit for production of material boards from a press material mat 14 is schematically depicted in FIG. 1 in a side view.

It consists, in its main parts, of one or more stranding stations 16, from which a press material mat 14 is continuously spread in one or more layers on a shaping belt 6. A pre-press 17 is situated in the production direction 3, consisting of an endless hold-down belt 19 revolving above the shaping belt 6. To support the shaping belt 6 at higher hold-down pressures, an endless revolving guide belt 18 can be arranged underneath. A continuously operating press 1 is shown in the practical example, which is designed as a double-belt press with revolving steel belts 7 and heatable press/heating plates 2. The revolving steel belts 7 are supported relative to the press/heating plates 2 by means of roller bodies 5, for example, endless roller bars guided parallel to each other. The continuous furnace 4 is arranged right in front of the input steel belts 5 of the continuously operating press 1. The press material mat 14 is then transferred for passage through the continuous furnace 4 from the shaping belt 6 to the lower plastic belt 11 and, depending on the type and design of the continuous furnace 4, is optionally clamped with a circulating plastic belt 8 on the top. The absorber bricks 25, arranged on both sides relative to microwave generator 26, are arranged raisable and lowerable via height adjustment 12 and are set according to the height of the press material mat passing through. The height adjustment for the plastic belt 8 revolving above is not shown. The upper plastic belt 8 has the task of protecting the continuous furnace 4 from increased dust development by the press material mat 14 and preventing the press material mat 14 from springing back to the initial state during transport before pre-compaction by the pre-press 17. The upper plastic belt 8 can also prevent escape of moisture during preheating.

Depending on the overall layout of the production installation, it is possible to design the shaping belt 6 as a microwave-compatible shaping belt 6 and to transport the press material mat 14 without transfer through the continuous furnace 4.

Microwave-compatible shaping of plastic belt 6, 8, 11 is characterized by the fact that during passage through the region of the microwave generator 26, they are only heated by about 10°. A microwave belt made of KEVLAR® with a Teflon coating on one or both sides is suitable for this purpose.

Figure 2:
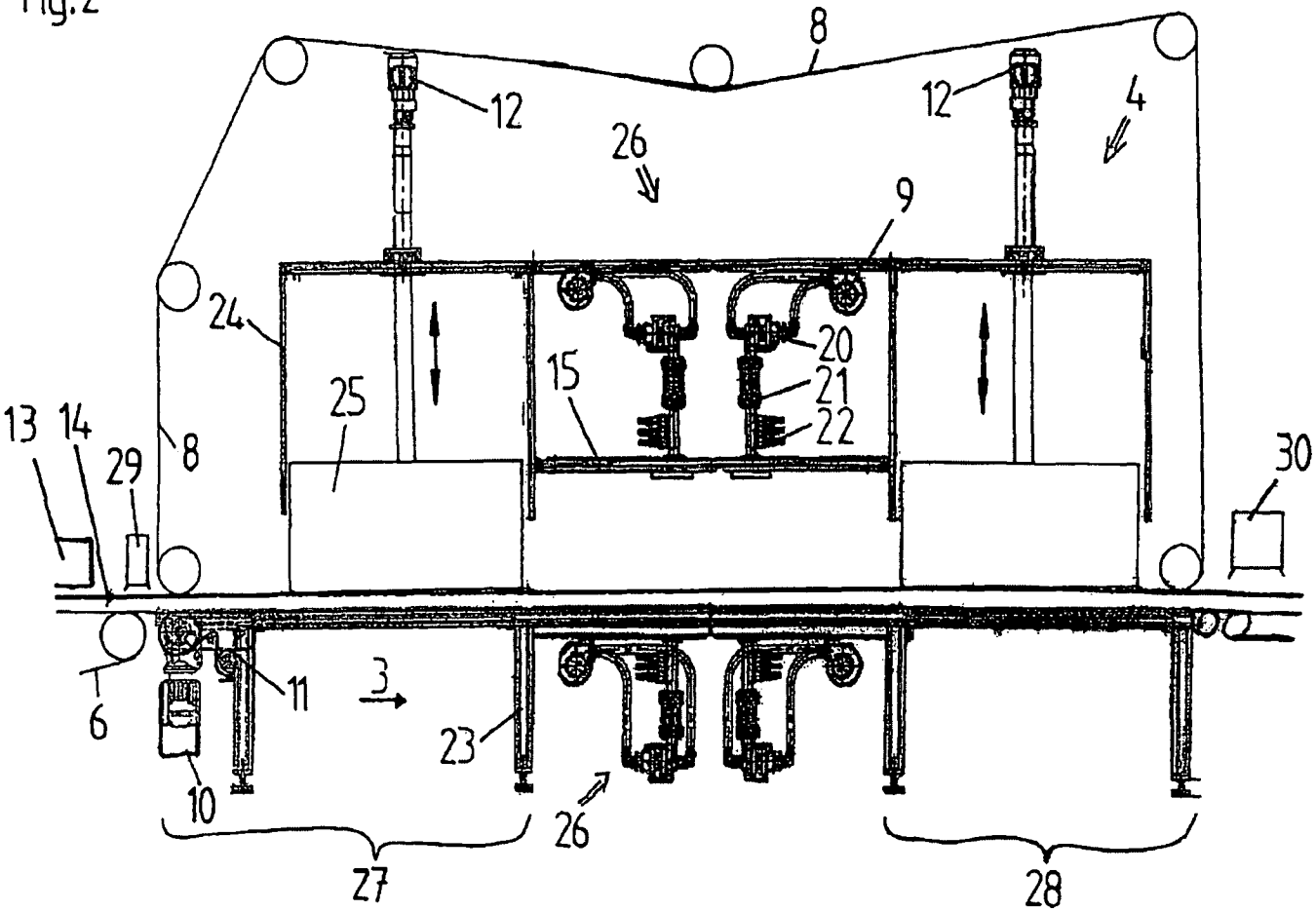
FIG. 2 shows an enlarged view of a device for preheating of a press material mat by microwaves according to FIG. 1

As shown in FIG. 2, a simple arrangement of the continuous furnace 4 is constructed as follows. The mechanism of the lower plastic belt 11 with corresponding drive 11 is situated on a lower frame 23. The shaping belt 6 transfers the press material mat 14 onto the lower plastic belt 11. The gap between the two revolving endless belts can be easily spanned in the press material mat 14, otherwise means are provided that ensure that a press material mat 14 protrudes undamaged over the transition onto the lower plastic belt 11 of the continuous furnace 4. In the upper frame 24, a height adjustment 12 for the absorption elements 25 provided at the inlet 27 and outlet 28 of the continuous furnace 4 are arranged, in order to properly shield the microwave radiation generated by the microwave generator 26, in order to be able to preheat different heights on the press material mats 14. In the same manner, the inlet 27 and outlet 28 can also be adjusted in width. This width adjustment and height adjustment for the upper revolving plastic belt 8 are not shown. The absorption elements 25 can be designed as absorber bricks or water containers. In addition to the absorption elements 25, however, reflectors (for example, perforated plates or other appropriate means) could be provided or a combination of both possibilities. The reflectors are preferably arranged so that they introduce the scattered radiation directly back into the press material mat 14. Sensors 29 can also be arranged that record the height and width of the press material mat 14 and adjust the inlet 27 and outlet 28 of the press material mat 4 accordingly.

The microwave generators 26 are arranged on the holding frame 15 in the center of the continuous furnace 4. A microwave generator 26 consists of at least one magnetron 20, a corresponding circulator 21 and a tuner 22. The tuner 22 assumes fine adjustment of the microwave radiation and its alignment, whereas the circulator 21 absorbs back-radiating microwaves and sends them to further use. Generally, primarily water from water cooling 9 is then heated, in order to absorb the excess microwaves. The metal detector of the device is shown with 13. Depending on the design of the installation, this can be arranged directly above the shaping belt 6 in front of the continuous furnace 4. A discharge or elimination possibility of a press material mat mixed with metal pieces is preferably present in front of the continuous furnace 4. As an alternative, or also if the metal detector 13 is arranged within the range of the plastic belts 8, 11 in front of the absorber bricks, the microwave generators 26 are briefly shut off, when a metal piece passes through and the part of the press material mat 14 that was not heated is disposed of via a discharge arranged right in front of press 1 in the production direction.

Figure 3:
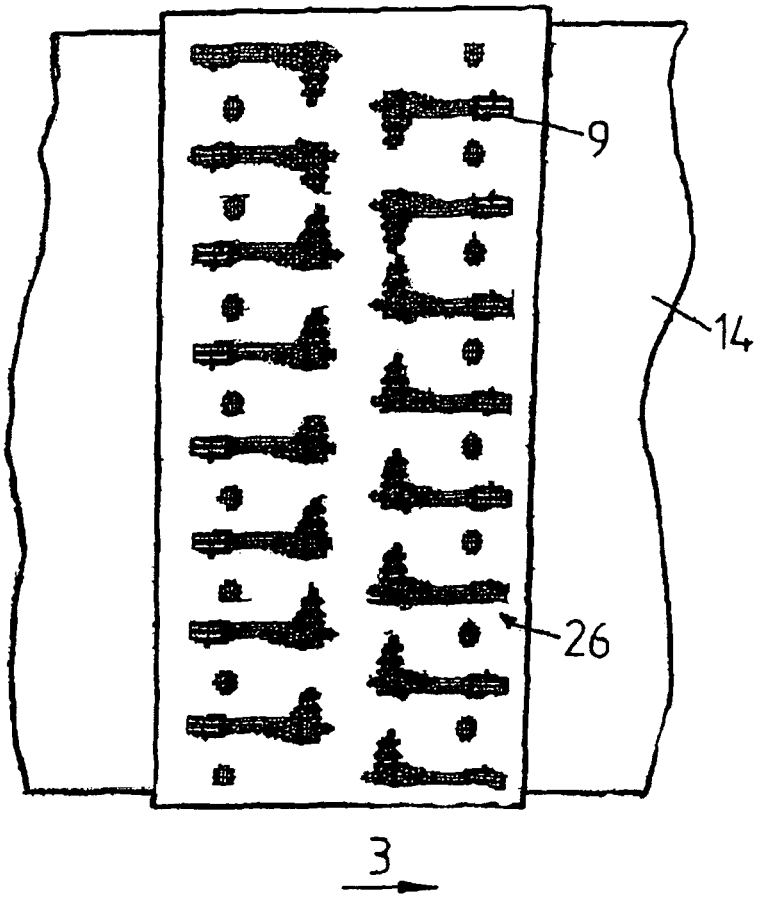
FIG. 3 shows a top view of a device for preheating of a press material mat with a schematic arrangement of the microwave generators.

In the top view of FIG. 3, the variety of necessary microwave generators 26 over the width of a press material mat 14 is apparent, which are conveyed in the production direction 3 in the direction of the continuously operating press 1. It is clear to one skilled in the art that radiation of microwaves must be conducted from the press surface sides, which then come in contact with the steel belt 7 of press 1. Microwave radiation over the narrow and long surfaces of the edge of the press material mat is not useful, because of the theoretically and practically determined penetration depth.

With respect to maintenance suitability of the installation, it is preferably prescribed to use a modular design of the individual parts in the continuous furnace 4, like magnetron 20, circulator 21 and tuner 22, of a microwave generator 26 and to provide for rapid replacement during defects or maintenance.

As an alternative or in combination it would be advantageous if each microwave generator 26 in continuous furnace 4 is constructed as its own module and optionally has quick-change closures for disassembly and assembly. To increase operational safety, it is preferably possible in or on the continuous furnace 4 to arrange sensors for spark and/or fire recognition in and/or on the press material mat 14 and/or means to extinguish a fire.

List of reference numbers:

| | |
|---|---|
| 1. | Continuously operating press |
| 2. | Press/heating plate in 1 |
| 3. | Production direction |
| 4. | Continuous furnace |
| 5. | Roller bodies |
| 6. | Shaping belt |
| 7. | Steel belts |
| 8. | Upper plastic belt |
| 9. | Water cooling |
| 10. | Dryer for 11 |
| 11. | Lower plastic belt |
| 12. | Height adjustment |
| 13. | Metal detector |
| 14. | Press material mat |
| 15. | Holding frame for 26 |
| 16. | Stranding station |
| 17. | Pre-press |
| 18. | Guide belt bottom |
| 19. | Hold-down belt |
| 20. | Magnetron |
| 21. | Circulator |
| 22. | Tuner |
| 23. | Frame top |
| 24. | Frame bottom |
| 25. | Absorption elements |

-continued

| List of reference numbers: | |
|---|---|
| 26. | Microwave generator |
| 27. | Entry |
| 28. | Exit |
| 29. | Sensors |

The invention claimed is:

1. A method for preheating a press material mat spread on an endless, continuously revolving shaping belt during production of wooden boards, the method comprising:

preheating the press material mat in a continuous furnace by emitting microwaves having a frequency ranging from 2400-2500 MHz into the press material mat from one or both press surface sides using 20 to 300 microwave generators for each press surface side, each microwave generator comprising at least one magnetron having a power ranging from 3 to 50 kW.

2. The method according to claim 1, further comprising examining the press material mat for metal parts having a dimension longer in length than ¼ of a wavelength of a microwave frequency.

3. The method according to claim 1, wherein an entry, an exit or a combination thereof of the continuous furnace is automatically adjusted in height and width to the press material mat.

4. The method according to claim 1, further comprising guiding the press material mat directly through the continuous furnace via a shaping belt that is microwave-compatible.

5. The method according to claim 1, further comprising heating a plastic belt used in the continuous furnace less than 10° C. during a pass.

6. The method according to claim 1, wherein by using an upper endlessly revolving plastic belt in the continuous furnace, escape of moisture from the press material mat is prevented.

7. The method according to claim 1, wherein absorption elements in the continuous furnace are brought as close as possible to the press material mat during passage of the press material mat.

8. The method according to claim 7, wherein the absorption elements comprise absorber bricks or water vessels.

9. The method according to claim 1, further comprising reintroducing excess scattered radiation back into the press material mat via reflectors.

10. The method according to claim 1, further comprising automatically switching off the microwave generators in areas in the continuous furnace in which no press material mat is conveyed, in areas in the continuous furnace in which foreign metal objects are detected or a combination thereof.

11. The method according to claim 1, further comprising converting cooling power by heat feedback for remote heat.

12. The method according to claim 1, further comprising checking the press material mat for sparks or fires during passage of the press material mat through the continuous furnace.

13. The method according to claim 12, further comprising automatically extinguishing the sparks, the fires or a combination thereof.

14. A method for preheating a press material mat spread on an endless, continuously revolving shaping belt during production of wooden boards, the method comprising:

preheating the press material mat in a continuous furnace by emitting microwaves having a frequency ranging from 2400-2500 MHz into the press material mat from one or both press surface sides using 20 to 300 microwave generators for each press surface side, each microwave generator comprising at least one magnetron having a power ranging from 3 to 50 kW, wherein the preheating produces a uniform temperature distribution of ±7° C. in the press material mat over a length and a width of the press material mat.

* * * * *